US007073769B2

(12) United States Patent
Bauer et al.

(10) Patent No.: US 7,073,769 B2
(45) Date of Patent: Jul. 11, 2006

(54) OVERPRESSURE GENERATOR AND VALVE

(75) Inventors: Bertram Bauer, Gaggenau (DE); Harald Merz, Sinzheim (DE); Wolfgang Paessler, Ottersweier (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/863,405

(22) Filed: Jun. 8, 2004

(65) Prior Publication Data

US 2004/0217309 A1 Nov. 4, 2004

Related U.S. Application Data

(62) Division of application No. 10/204,165, filed as application No. PCT/DE01/04504 on Nov. 30, 2001, now Pat. No. 6,799,601.

(30) Foreign Application Priority Data

Dec. 19, 2000 (DE) ..... 100 63 273

(51) Int. Cl.
*F16K 31/126* (2006.01)

(52) U.S. Cl. ..... 251/61.4

(58) Field of Classification Search ..... 251/61.2, 251/61.4; 137/625.13, 625.48
See application file for complete search history.

(56) References Cited

U.S. PATENT DOCUMENTS

| | | | | |
|---|---|---|---|---|
| 5,199,853 | A | 4/1993 | Padden | |
| 5,738,138 | A * | 4/1998 | Grunert et al. | 137/245 |
| 6,105,929 | A * | 8/2000 | Davenport et al. | 251/63.6 |
| 6,430,950 | B1 | 8/2002 | Dienhart et al. | |

FOREIGN PATENT DOCUMENTS

| | | |
|---|---|---|
| DE | 34 00 545 A1 | 7/1984 |
| DE | 198 52 127 A1 | 5/2000 |
| GB | 2 133 585 A | 7/1984 |

* cited by examiner

*Primary Examiner*—Justine R. Yu
*Assistant Examiner*—Peter deVore
(74) *Attorney, Agent, or Firm*—Michael J. Striker

(57) ABSTRACT

The invention relates to a device for at least intermittently generating an overpressure in a system S in relation to an ambient pressure U, with a pump P that has a pressure side 20 and an intake side 10, where during the generation of an overpressure, the pressure side 20 is connected to the system S and the intake side 10 is connected to the ambient pressure by means of at least one first valve MV1, in particular a solenoid valve.

According to the invention, means are provided, which can provide an additional cross section for the intake volume flow during the generation of an overpressure.

The invention also relates to a valve, which is particularly provided for use with the device according to the invention.

12 Claims, 4 Drawing Sheets

OVERPRESSURE GENERATOR AND VALVE

Divisional of prior application Ser. No. 10/204,165 filed Aug. 19, 2002, now U.S. Pat. No. 6,799,601 which is a 371 of PCT/DE01/04504, filed Nov. 30, 2001.

The current invention relates to a device for at least intermittently generating an overpressure in a system in relation to an ambient pressure, with a pump that has a pressure side and an intake side, where during the generation of an overpressure, the pressure side is connected to the system and the intake side is connected to the ambient pressure by means of at least one first valve, in particular a solenoid valve, and the first valve throttles the intake volume flow due to its cross section. Furthermore, the current invention also relates to a valve, in particular an additional valve for the device according to the invention, with a valve inlet and a valve outlet that can be connected to each other.

PRIOR ART

Devices of this generic type include, for example, devices that are provided for connecting the pressure side or the intake side of a compressor or pump to a system by means of two solenoid valves in such a way that either an overpressure or a vacuum can be generated in the system. Known devices suitable for this are shown in FIGS. 1 and 2.

Figure 1:
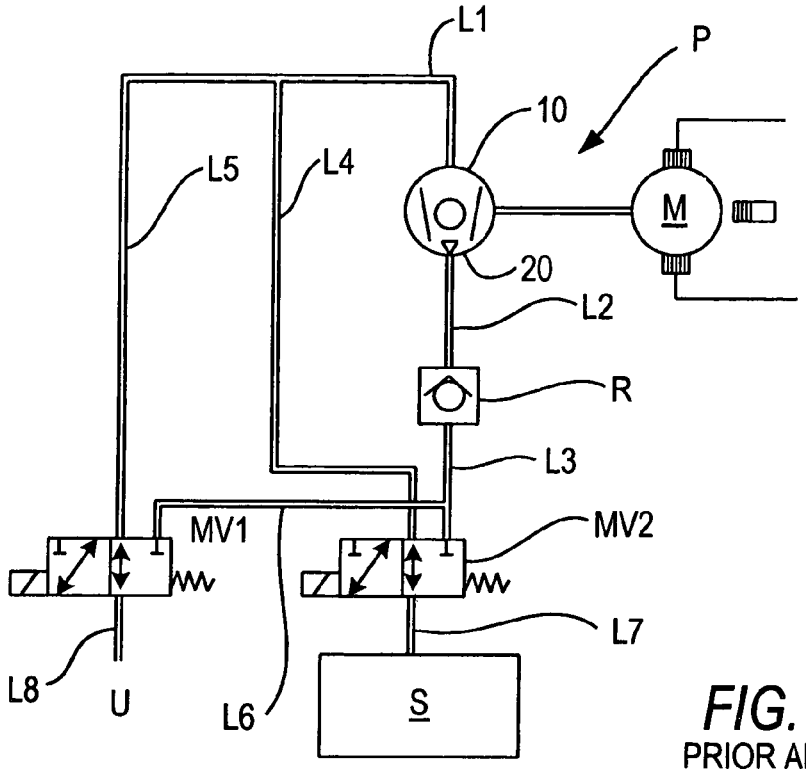
FIG. 1 PRIOR ART
Figure 2:
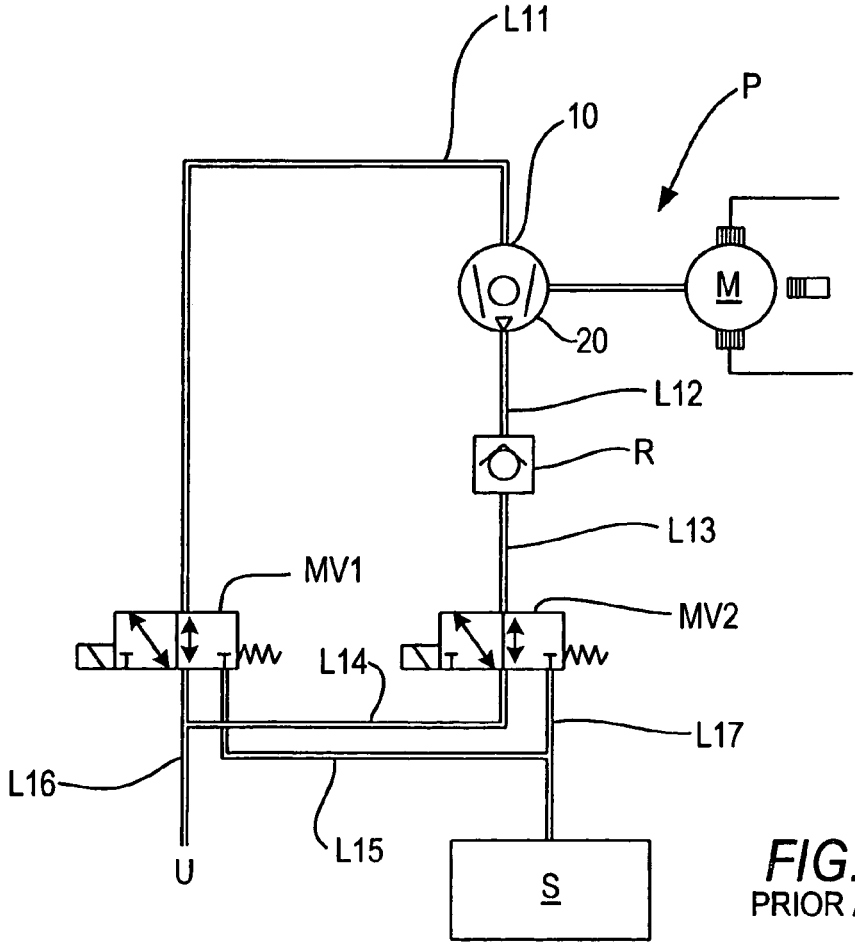
FIG. 2 PRIOR ART

FIG. 1 shows a device that has a compressor or pump P with an intake side 10 and a pressure side 20. The pressure side 20 of the pump P is associated with a check valve R, which is connected by means of an output L2 to the pressure side 20 of the pump P. The device shown is provided for generating an overpressure or a vacuum in a system S. To this end, a first solenoid valve MV1 and a second solenoid valve MV2 are provided, by means of which the pump P can be connected to the system S in a suitable fashion. The first solenoid valve MV1 and the second solenoid valve MV2 are shown in their respective neutral positions. In this neutral position, the system S is connected to the ambient pressure by means of a line L7, the second solenoid valve MV2, a line L4, a line L5, the first solenoid valve MV1, and a line L8.

In order to generate an overpressure in the system S shown in FIG. 1, the second solenoid valve MV2 is switched. As a result, the system S is connected to the pressure side 20 of the pump P by means of the second solenoid valve MV2, the line L3, the check valve R, and the line L2. In the switched position of the second solenoid valve MV2, the line L4 is closed by the second solenoid valve MV2. The line L6 is likewise closed by the first solenoid valve MV1, which is in its neutral position. During overpressure operation, the intake side 10 of the pump P is connected to the ambient pressure U by means of a line L1, a line L5, the first solenoid valve MV1, and a line L8.

In order to generate a vacuum in the system S shown in FIG. 1, the first solenoid valve MV1 is switched out of the position shown in FIG. 1, while the second solenoid valve MV2 remains in the neutral position shown in FIG. 1. In this position of the first solenoid valve MV1, the line L5 is closed by the first solenoid valve MV1, while the line L6 is connected by the first solenoid valve MV1 to the line L8 and therefore to the ambient pressure. As a result, the pressure side 20 of the pump P is connected to the ambient pressure by means of the line L8, the first solenoid valve MV1, the line L6, the line L3, the check valve R, and the line L2. The system S is therefore connected to the intake side 10 of the pump P by means of the line L7, the second solenoid valve MV2, the line L4, and the line L1. As mentioned above, in the generic device according to FIG. 1, the system S is connected to the ambient pressure U when the first solenoid valve MV1 and the second solenoid valve MV2 are in their neutral positions.

By contrast, in the likewise known device according to FIG. 2, the system S is sealed when the solenoid valves are disposed in their neutral positions, as will be explained in detail below. The device according to FIG. 2 also has a pump P with an intake side 10 and a pressure side 20. The pump P is once again associated with a check valve R, which is connected by means of a line L12 to the pressure side 20 of the pump P. The system in which the overpressure or vacuum is to be generated is once again labeled with the reference letter S and the ambient pressure is once again labeled with the reference letter U. The device has a first solenoid valve MV1 and a second solenoid valve MV2, whose respective neutral positions are shown in FIG. 2. In these neutral positions, the line L17 is closed by the second solenoid valve MV2 while the line L15 is closed by the first solenoid valve MV1. As a result, the system S is sealed in the neutral position of the first solenoid valve MV1 and second solenoid valve MV2.

In order to generate an overpressure in the system S with the device according to FIG. 2, the second solenoid valve MV2 is switched, while the first solenoid valve MV1 remains in the neutral position shown in FIG. 2. When the second solenoid valve MV2 is switched, the system S is connected to the pressure side 20 of the pump P by means of the line L17, the second solenoid valve MV2, the line L13, the check valve R, and the line L12. The line L15 is closed by the first solenoid valve MV1 and line L14 is closed by the second solenoid valve MV2. During overpressure operation, the intake side 10 of the pump P is connected to the ambient pressure U by means of the line L11, the first solenoid valve MV1, and the line L16.

In order to generate a vacuum in the system S with the device according to FIG. 2, the first solenoid valve MV1 is switched out of the position shown in FIG. 2, while the second solenoid valve MV2 remains in its neutral position. As a result, the system S is connected to the intake side 10 of the pump P by means of a section of the line L17 that is closed by the second solenoid valve MV2, the line L15, the first solenoid valve MV1, and the line L11. During vacuum operation the pressure side 20 of the pump P is connected to the ambient pressure U by means of the line L12, the check valve R, the line L13, the second solenoid valve MV2, the line L14, and a section of the line L16 that is closed by the first solenoid valve MV1.

One disadvantage of the known devices shown in FIGS. 1 and 2 lies in the fact that the intake volume flow is throttled by the respective intake-side first solenoid valve MV1, as a result of which the compressor or the pump P achieves a lower pneumatic output. One obvious solution to this problem, namely to avoid the undesirable throttling of the intake volume flow by providing the intake-side solenoid valve with a sufficiently large cross section, entails other problems. A valve of this kind with a sufficiently large cross section requires large dimensions, is heavy, and is therefore expensive. Furthermore, in many cases it is desirable to use identical or similar valves on both the pressure side and the intake side.

ADVANTAGES OF THE INVENTION

Because the device according to the invention has means for providing an additional cross section for the intake volume flow during the generation of an overpressure, a higher pneumatic output can be achieved with the pump.

Furthermore, the dimensions and weight of the first valve do not have to be increased and if a second valve is provided, identical or similar first and second valves are used.

A preferred embodiment of the device according to the invention provides that the means include at least one additional valve, which is connected in parallel to the first valve during the generation of an overpressure. As a result, the total cross section available for the intake volume flow can be increased by the cross section of the additional valve.

Particularly when the first valve is a solenoid valve, it is preferable that the additional valve be opened by an overpressure generated in the system. As a result, it is not necessary to provide additional energy sources for actuating the additional valve, but it is sufficient, for example, to connect a line leading to the system or the system itself to the additional valve in a suitable manner.

Preferably, the device according to the invention also includes the provision that if the pressure in the system decreases, then the additional valve is closed, preferably automatically, for example by means of the decreasing pressure itself.

In a preferred embodiment of the device according to the invention, a second valve, in particular a solenoid valve is provided; during the generation of the overpressure, the pressure side of the pump is connected to the system by means of the second valve.

Particularly in this instance, the device according to the invention can also be suitable for generating a vacuum in the system in relation to the ambient pressure. In this connection, the invention can include the provision that during the generation of the vacuum, the pressure side of the pump is connected to the ambient pressure by means of the first valve, while the intake side of the pump is connected to the system by means of the second valve. This can eliminate the disadvantages of the prior art mentioned at the beginning in conjunction with FIGS. 1 and 2.

Particular embodiments of the device according to the invention can include the provision that during the generation of an overpressure, the additional valve also functions as a pressure relief valve. This embodiment is particularly useful when the additional valve is connected to the system by means of a line and approximately the same pressure conditions as in the system prevail in at least a region of the additional valve.

The current invention also relates to a valve, in particular an additional valve for the device according to the invention, as has a ready been explained above. In this valve, the invention provides that the valve has a control pressure inlet, which is connected to a control chamber, and that the valve inlet is connected to the valve outlet when a predetermined pressure is exceeded in the control chamber. With regard to the device according to the invention, a valve of this kind can be actuated, for example, by the pressure prevailing in the system and as a result, during the generation of an overpressure, can provide an additional cross section for the intake volume flow without the need for additional energy sources to actuate the valve.

The valve according to the invention preferably includes the provision that the valve inlet is connected to the valve outlet by means of a spatial expansion of the control chamber.

To this end, the control chamber can be adjoined by a diaphragm, for example, which permits a spatial expansion of the control chamber. In this connection, the control chamber can be comprised, for example, by a housing that is open on one side; the open side of the control chamber is then adjoined by the diaphragm. Naturally, the housing can have suitable connections, for example in order to permit the control chamber to be connected to a system in which an overpressure is to be generated.

The valve according to the invention can also include the provision that on the side of the diaphragm oriented away from the control chamber, a valve chamber is provided, which is connected to a valve outlet, and the provision that the valve chamber is sealed off from the valve inlet in the neutral position of the diaphragm.

Particularly in this case, it can be advantageous if the valve chamber has a valve seat, which cooperates with a valve plate. The valve seat and the valve plate produce a reciprocal seal when the valve is closed.

In this connection, the invention can also include the provision that with a spatial expansion of the control chamber, the diaphragm acts on the valve plate in such a way that the valve chamber is connected to the valve inlet. As a rule, the valve plate is moved away from the valve seat for this purpose.

In this connection, the diaphragm can act on the valve plate, for example by means of a rod-shaped element.

The diaphragm and/or the rod-shaped element and/or the valve plate can be embodied of one piece with one another.

In addition, the diaphragm and/or the rod-shaped element and/or the valve plate can be comprised of a rubber-elastic material. Even in this embodiment, however, the rod-shaped element must be rigid enough to be able to transmit the required force from the diaphragm to the valve plate.

A preferred embodiment of the valve according to invention also includes the provision that when a maximal pressure in the control chamber is exceeded, the valve connects the control pressure inlet to the valve inlet and/or to the valve outlet. In this manner, the valve according to the invention can also function as a pressure relief valve.

To this end in particular, the invention can include the provision that a supporting plate acts on the diaphragm in order to seal off the control chamber from the valve chamber by means of the diaphragm as long as the maximal pressure in the control chamber is not exceeded.

In this connection, the supporting plate can be prestressed by a spring element, for example a spiral spring, in order to suitably act on the diaphragm. When the valve according to the invention is also functioning as a pressure relief valve, the spring force of a spring element of this kind can influence the maximal pressure at which the pressure relief valve opens.

In particular, in order to assure a sealing in relation to the valve inlet and/or the valve outlet in the neutral position of the valve, the invention can include the provision that a spring element prestresses the valve plate in the direction of the valve seat.

DRAWINGS

The invention will be explained in more detail below in conjunction with the accompanying drawings.

Figure 3:
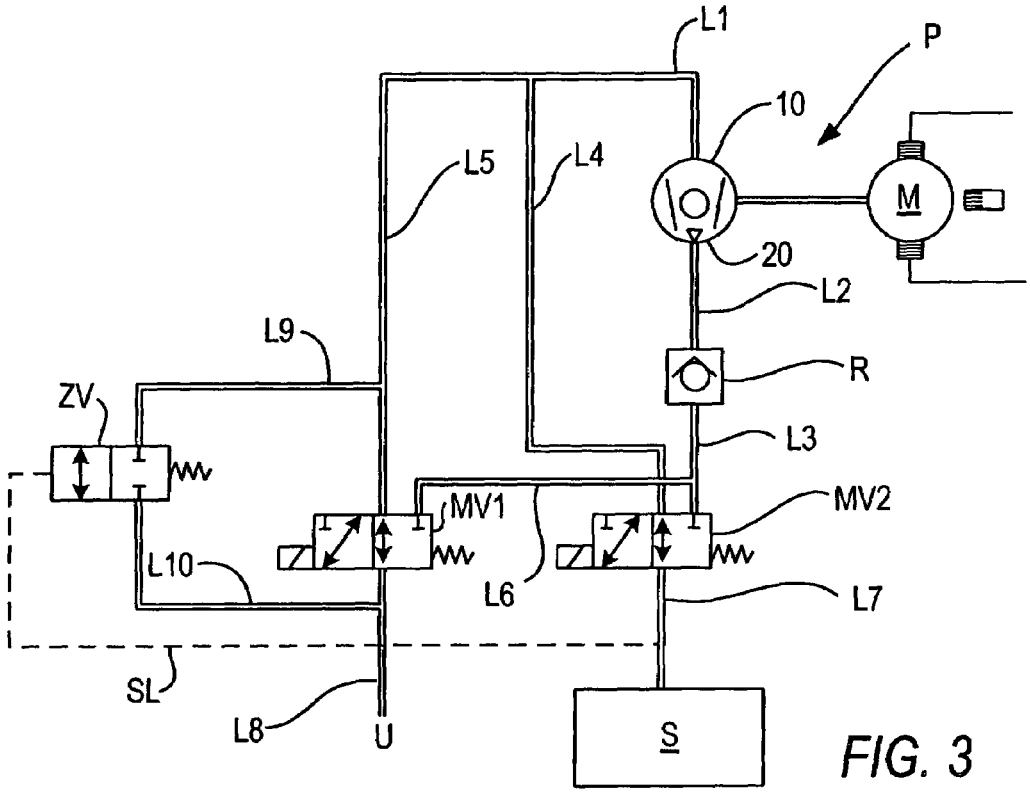
Figure 4:
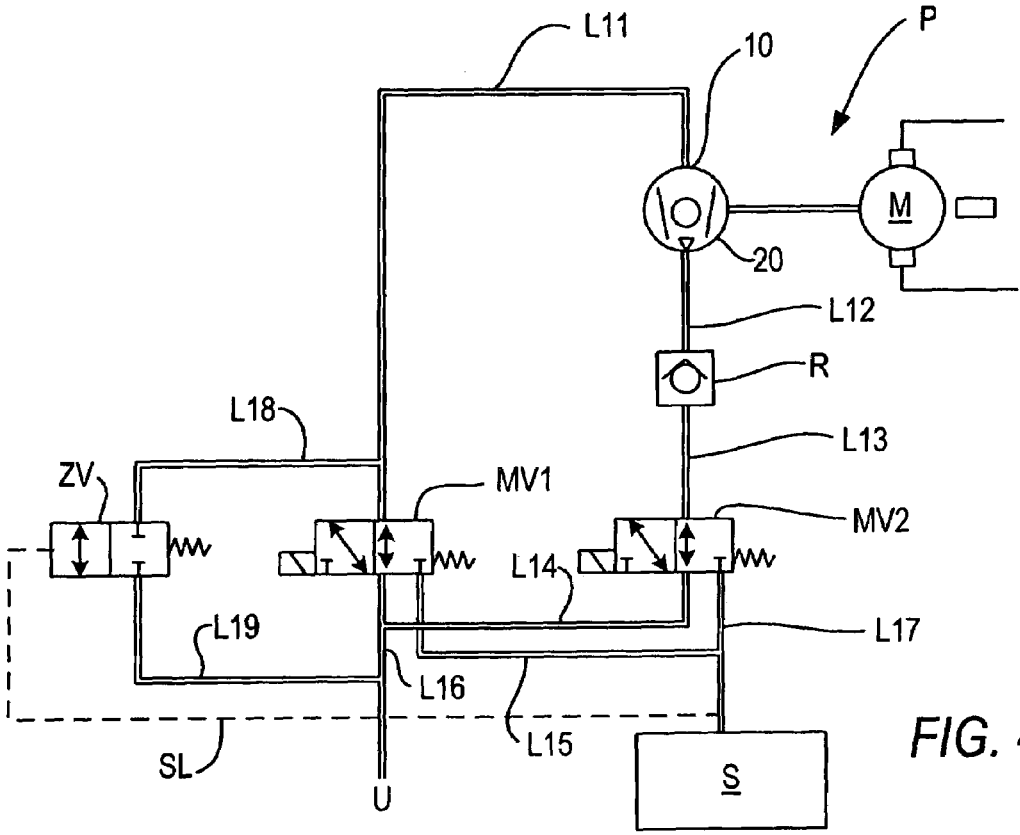
Figure 5:
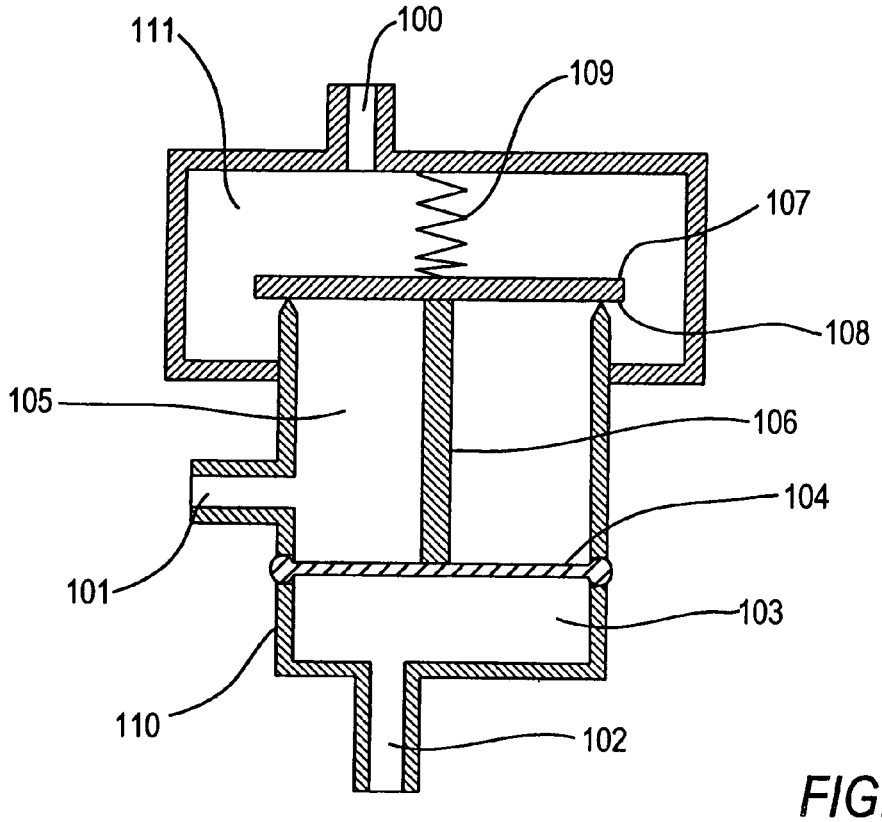
Figure 6:
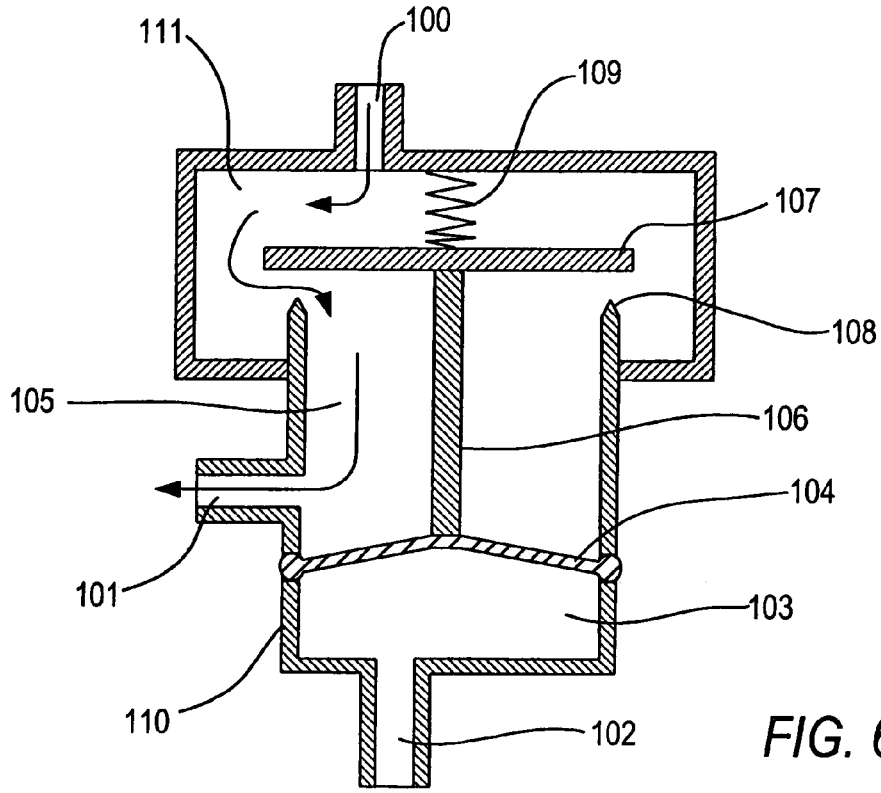
Figure 7:
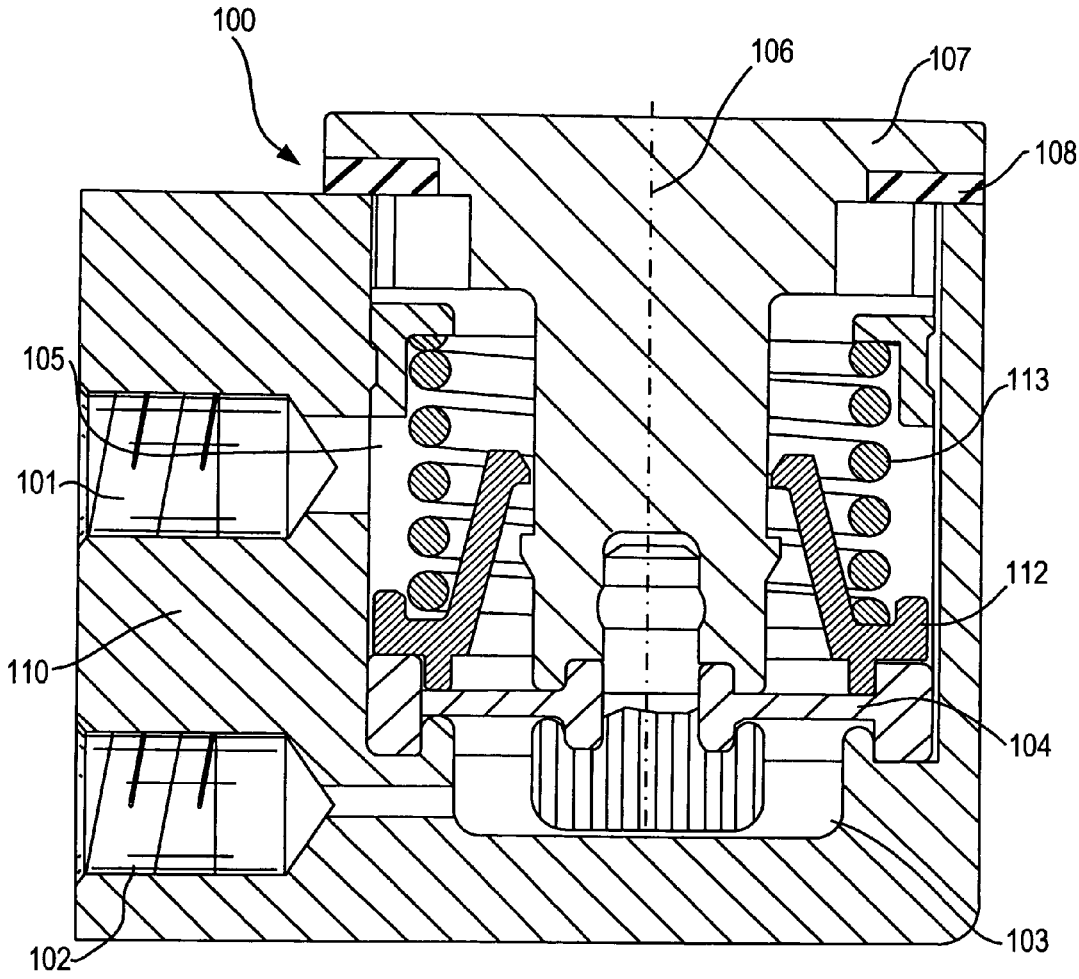

FIG. 1 shows a first embodiment of a generic device according to the prior art, FIG. 2 shows a second embodiment of a generic device according to the prior art, FIG. 3 shows a first embodiment of the device according to the invention, FIG. 4 shows a second embodiment of the device according to the invention, FIG. 5 shows a schematic representation of an embodiment of the valve according to the invention in its neutral position in which the valve is closed, FIG. 6 shows the valve according to FIG. 5 in a working position in which the valve is open, and FIG. 7 shows a possible practical embodiment of the valve according to the invention.

DESCRIPTION OF THE EXEMPLARY EMBODIMENTS

FIG. 3 shows an embodiment of the device according to the invention that is produced when the basic concepts of the current invention are applied to the device according to the prior art shown in FIG. 1. The embodiment according to FIG. 3, therefore, (once again) shows a device, which has a compressor or pump P with an intake side 10 and a pressure side 20. The pressure side 20 of the pump P is associated with a check valve R, that is connected by means of a line L2 to the pressure side 20 of the pump P. The device shown is provided to generate an overpressure or a vacuum in a system S. To this end, a first solenoid valve MV1 and a second solenoid valve MV2 are provided, which can connect the pump P. to the system S in a suitable fashion. The first solenoid valve MV1 and the second solenoid valve MV2 are shown in their respective neutral positions. In this neutral position, the system S is connected to the ambient pressure by means of a line L7, the second solenoid valve MV2, a line L4, a line L5, the first solenoid valve MV1, and a line L8.

In order to provide an additional cross section for the intake volume flow during the generation of an overpressure, in the embodiment shown in FIG. 3, an additional valve ZV is provided, which is connected in parallel with the first solenoid valve MV1 by means of two lines L9, L10. The additional valve can be constituted by a valve according to the invention; in this instance, the line L9 is connected to the valve outlet of the additional valve, while the line L10 is connected to the valve inlet of the additional valve ZV. In this instance, the control chamber of the additional valve ZV is connected by means of a control line SL to the system S or to a line L7 leading to the system. In the neutral position of the additional valve ZV shown in FIG. 3, both the line L9 and the line L10 are closed by the additional valve ZV. In the device shown in FIG. 3, the generation of an overpressure begins by switching the second solenoid valve MV2 while the first solenoid valve MV1 remains in its depicted neutral position. In this connection, the additional valve ZV is also initially closed. When the second valve MV2 is switched, the pressure side 20 of the pump P is connected to the system S by means of the line L2, the check valve R, the line L3, the second solenoid valve MV2, and the line L7. At this point, the intake side 10 of the pump P is connected to the ambient pressure by means of the line L1, the first solenoid valve MV1, and the line L8, as has been explained above. Through the operation of the pump P, an overpressure is built up in the system S in comparison to the ambient pressure and this overpressure is also supplied to the additional valve ZV by means of the control line SL. As soon as the overpressure in the system S and therefore in a region of the additional valve ZV, for example a control chamber, exceeds a predetermined value, the additional valve ZV opens, which connects its valve inlet to its valve outlet and thereby to the lines L9 and L10. This provides an additional cross section, namely the cross section of the additional valve ZV, for the intake volume flow so that the throttling of the intake volume flow by means of the first solenoid valve MV1 no longer has a negative impact. As soon as the overpressure in the system S and therefore in the additional valve ZV decreases again, the additional valve ZV returns to its neutral position in which the lines L9 and L10 are closed.

The additional valve ZV has no effect on the generation of a vacuum in the system S because during the generation of a vacuum, it remains in its neutral position in which the lines L9 and L10 are closed by additional valve ZV. In order to generate a vacuum in the system S, therefore, the first solenoid valve MV1 is (likewise) switched. out of the position shown in FIG. 3, while the second solenoid valve MV2 and additional valve ZV remain in the neutral position shown in FIG. 1. In this position of the first solenoid valve MV1, the line L5 is closed by the first solenoid valve MV1, while the line L6 is connected by means of the first solenoid valve MV1 to the line L8 and therefore to the ambient pressure. As a result, the pressure side 20 of the pump P is connected to the ambient pressure by means of the line L8, the first solenoid valve MV1, the line L6, the line L3, the check valve R, and the line L2. In this case, the system S is connected to the intake side 10 of the pump P by means of the line L7, the second solenoid valve MV2, the line L4, and the line L1.

FIG. 4 shows a device that is produced when the basic concepts of the invention are applied to the known device according to FIG. 2, in which the system S is sealed when the solenoid valves are disposed in their neutral positions. The device according to FIG. 4, therefore, likewise has a pump P with an intake side 10 and a pressure side 20. The pump P is once again associated with a check valve R, which is connected by means of a line L12 to the pressure side of the pump P. The system in which the overpressure or the vacuum is to be generated is once again labeled with the reference letter S and the ambient pressure is labeled with the reference letter U. The device has a first solenoid valve MV1 and a second solenoid valve MV2, whose respective neutral positions are shown in FIG. 2. In this neutral position, the line L17 is closed by the second solenoid valve MV2, while the line L15 is closed by the first solenoid valve MV1. As a result, the system S is sealed in the neutral position of the first solenoid valve MV1 and second solenoid valve MV2.

In the embodiment according to FIG. 4, the means for providing an additional cross section for the intake volume flow during the generation of an overpressure are also comprised of an additional valve ZV, which can likewise be comprised of a valve according to the invention, as in the embodiment according to FIG. 3. Based on the depiction in FIG. 4, in which the additional valve ZV, the first solenoid valve MV1, and the second solenoid valve MV2 are disposed in their respective neutral positions, the generation of an overpressure in the system S begins with the switching of the second solenoid valve MV2. As a result, the system S is connected to the pressure side 20 of the pump P by means of the line L17, the second solenoid valve MV2, the line L13, the check valve R, and the line L12, while the intake side 10 of the pump P is connected to the ambient pressure by means of the line L11, the first solenoid valve MV1, and the line L16. As mentioned above, the additional valve ZV is initially closed, i.e. it closes the lines L18 and L19 by means of which is connected in parallel with the first solenoid valve MV1. At least a region of the additional valve ZV, for example a control chamber, is connected by means of a control line SL to the system S or to a line L17 leading to the system. As soon as the pressure in the system S and therefore in a region of the additional valve ZV exceeds a certain pressure, the additional valve ZV opens and connects the lines L18 and L19, which provides the additional cross section for the intake volume flow so that the throttling of the intake volume flow by the first solenoid valve MV1 no longer has. a negative impact. As soon as the pressure in the system S and in a corresponding region of the additional valve ZV decreases again, the additional valve ZV returns to its neutral position in which it closes the lines L18 and L19, as shown in FIG. 4.

In this embodiment as well, the additional valve ZV has no effect on the generation of a vacuum in the system S, since it remains in the neutral position shown in which it closes the lines L18 and L19. In order to generate a vacuum in the system S with the device according to FIG. 4, therefore, the first solenoid valve MV1 is switched out of the position shown in FIG. 4, while the second solenoid valve MV2 and the additional valve ZV remain in the neutral position. As a result, the system S is connected to the intake side 10 of the pump P by means of a section of the line L17 that is closed by the second solenoid valve MV2, the line L15, the first solenoid valve MV1, and the line L11. During vacuum generation, the pressure side 20 of the pump P is connected to the ambient pressure U by means of the line L12, the check valve R, the line L13, the second solenoid valve MV2, the line L14, and a section of the line L16 that is closed by the first solenoid valve MV1.

FIG. 5 shows a schematic depiction of a valve according to the invention, which can be used, for example, as an additional valve in the device according to FIG. 3 and the device according to FIG. 4. According to the depiction in FIG. 5, the valve is disposed in the neutral position in which it is closed. In this closed position, the valve inlet 100 and the valve outlet 101 are not connected to each other. A valve housing, which is labeled as a whole with the reference numeral 110, includes, among other things, the lower section of a control chamber 103 into which the control pressure inlet 102 feeds. The control chamber 103 is adjoined at the top by a diaphragm 104, whose circumference is fastened to the housing 110 in a sealed fashion. Above the diaphragm 104, there is a valve chamber 105 into which the valve outlet 101 feeds. The valve chamber 105, which is closed in the depiction of FIG. 5, forms a valve seat 108 with its upper end section. The valve seat 108 cooperates with a valve plate 107, which is connected to the diaphragm 104 by means of a rod-shaped element 106. In the embodiment shown, the valve plate 107 is prestressed in the direction of the valve seat by a spring element 109 so that a good seal is produced between the valve plate 107 and the valve seat 108. In the embodiment according to FIG. 5, a valve inlet chamber 111 is provided, into which the valve inlet 100 feeds. A valve inlet chamber 111 of this kind can be omitted, for example, if the valve inlet is to be constituted by the region surrounding the valve. Because a spring 109 prestresses the valve plate 107 in the direction of the valve seat 108, both the valve inlet 100 and the valve outlet 101 are sealed in the neutral position of the valve.

FIG. 6 shows the valve from FIG. 5 in a working position in which the valve inlet 100 is connected to the valve outlet 101. An overpressure in the control chamber 103 has deformed the diaphragm 104 so that it acts on the valve plate 107 by means of the rod-shaped element 106 in such a way that this valve plate 107 is lifted up from the valve seat 108 counter to the initial stress of the spring 109. As a result, the valve inlet 100 is connected to the valve outlet 101 by means of the valve inlet chamber 111 and the valve chamber 105, thus causing the valve to open. As soon as the overpressure in the control chamber 103 decreases again, the diaphragm 104 returns to its neutral position, as a result of which the valve plate 107 moves downward and comes to rest in a sealed fashion against the valve seat 108.

FIG. 7 shows a sectional view of a possible practical embodiment of the valve according to the invention. Once again, the valve has a housing that is labeled as a whole with the reference numeral 110. A valve outlet 101 feeds into a valve chamber 105. The valve inlet 100 in the embodiment according to FIG. 7 is constituted by a spacing, not shown, between the valve plate 107 and the valve seat 108, which is produced when the valve opens. A control pressure inlet 102 feeds into a control chamber 103, which is adjoined at the top by a diaphragm 104. In the embodiment according to FIG. 7, the valve additionally functions as a pressure relief valve. To this end, a supporting plate 112 is provided, which acts on the outer region of the diaphragm 104 through the action of a spring 113 in such a way that during normal operation, this diaphragm 104 seals the control chamber 103 off from the valve chamber 105. The functional operation for connecting the valve inlet 100 to the valve outlet 101 of the valve shown in FIG. 7 corresponds to the functional operation that has been explained above in conjunction with FIGS. 5 and 6. As soon as the pressure in the control chamber 103 exceeds a certain value, the diaphragm 104 is deformed in such a way that the rod-shaped element 106 and the valve plate 107 that is embodied of one piece with it are moved upward, which produces the above-mentioned spacing between the valve plate 107 and the valve seat 108. When the pressure in the control chamber 103 exceeds the predetermined maximal pressure, then the circumference region of the diaphragm 104 moves upward, counter to the initial stress exerted by the spring 113, and therefore connects the control pressure inlet 102 to the valve outlet 101, thus performing the function of a pressure relief valve. In the embodiment according to FIG. 7, the valve plate 107 is embodied of one piece with the rod-shaped element 106, for example is comprised of a strong plastic material, while the diaphragm 104 is comprised of an elastic material. However, there are also conceivable embodiments in which, for example, the diaphragm 104, the rod-shaped element 106, and the valve plate 107 are embodied in one piece of a single material, which at least when it has a thin cross section, is sufficiently elastic to perform the function of the diaphragm 104.

In the above description, the first valve and the second valve have been described in the form of corresponding solenoid valves. The invention, however, is not limited to the use of such solenoid valves, but can be produced with any other valves, for example pneumatic valves.

The medium flowing through the lines of the device according to the invention and the medium contained in the system S, whose pressure is to be increased or decreased, can be the same medium or different mediums. In particular, if these mediums are different, suitable separating devices can be provided in the system S, for example in the form of a diaphragm or the like. Possible flow mediums include all suitable fluid of the gaseous materials.

The ambient pressure U does not absolutely have to be an atmospheric ambient pressure; the ambient pressure can also be any pressure prevailing in another system.

The preceding description of exemplary embodiments according to the current invention is only intended for illustrative purposes and not to limit the invention. As part of the invention, numerous changes in modifications are possible without going beyond the scope of the invention or its equivalents.

The invention claimed is:

1. A valve for a device for at least intermittently generating an overpressure in a system (S) in relation to an ambient pressure, the valve comprising a valve inlet (100)

and a valve outlet (101), which can be connected to each other, characterized in that the valve has a control pressure inlet (102) that is connected to a control chamber (103) and that the valve inlet (100) is connected to the valve outlet (101) when a predetermined pressure is exceeded in the control chamber (103), wherein when a maximal pressure in the control chamber (103) is exceeded, the valve connects the control pressure inlet (102) to the valve inlet (100) and/or to the valve outlet (101).

2. The valve according to claim 1, wherein the valve inlet (100) is connected to the valve outlet (101) by means of a spatial expansion of the control chamber (103).

3. The valve according to claim 1, wherein the control chamber (103) is adjoined by a diaphragm (104), which permits the spatial expansion of the control chamber (103).

4. The valve according to claim 3, wherein on the side of the diaphragm (104) oriented away from the control chamber (103), a valve chamber (105) is provided, which is connected to the valve outlet (101), and wherein the valve chamber (105) is sealed off from the valve inlet (100) in a neutral position of the diaphragm (104).

5. The valve according to claim 4, wherein the valve chamber (105) has a valve seat (108), which cooperates with a valve plate (107).

6. The valve according to claim 5, wherein with a spatial expansion of the control chamber (103), the diaphragm (104) acts on the valve plate (107) in such a way that the valve chamber (106) is connected to the valve inlet (100).

7. The valve according to claim 5, wherein the diaphragm (104) acts on the valve plate (107) by means of a rod-shaped element (106).

8. The valve according to claim 7, wherein the diaphragm (104) and/or the rod-shaped element (106) and/or the valve plate (107) are embodied of one piece with one another.

9. The valve according to claim 7, wherein the diaphragm (104) and/or the rod-shaped element (106) and/or the valve plate (107) are comprised of a rubber-elastic material.

10. The valve according to claim 4, wherein a supporting plate (112) acts on the diaphragm (104) in order to seal off the control chamber (103) from the valve chamber (105) by means of the diaphragm (104) as long as a maximal pressure in the control chamber (103) is not exceeded.

11. The valve according to claim 10, wherein the supporting plate (112) is prestressed by a spring element (113), in order to act on the diaphragm (104).

12. The valve according to claim 6, wherein the valve plate (107) is prestressed in the direction of the valve seat (108) by a spring element (109).

* * * * *